US006080060A

United States Patent [19]

Larsson

[11] Patent Number: 6,080,060

[45] Date of Patent: Jun. 27, 2000

[54] EQUIPMENT FOR AIR SUPPLY TO A ROOM

[75] Inventor: Bertil Larsson, Tyresö , Sweden

[73] Assignee: ABB Fläkt Aktiebolag, Stockholm, Sweden

[21] Appl. No.: 09/155,611

[22] PCT Filed: Mar. 20, 1997

[86] PCT No.: PCT/SE97/00461

§ 371 Date: Sep. 30, 1998

§ 102(e) Date: Sep. 30, 1998

[87] PCT Pub. No.: WO97/37173

PCT Pub. Date: Oct. 9, 1997

[30] Foreign Application Priority Data

Apr. 1, 1996 [SE] Sweden ..... 9601280

[51] Int. Cl.[7] ..... F24F 7/06

[52] U.S. Cl. ..... 454/187; 454/236

[58] Field of Search ..... 454/187, 228, 454/236; 55/385.2

[56] References Cited

U.S. PATENT DOCUMENTS

| | | | |
|---|---|---|---|
| 2,609,743 | 9/1952 | Ashley et al. . | |
| 3,824,909 | 7/1974 | Horneff et al. . | |
| 4,549,472 | 10/1985 | Endo et al. | 454/236 X |
| 4,699,640 | 10/1987 | Suzuki et al. . | |
| 4,873,914 | 10/1989 | Hirayama et al. . | |
| 5,058,491 | 10/1991 | Wiemer et al. . | |
| 5,326,316 | 7/1994 | Hashimoto et al. . | |
| 5,752,985 | 5/1998 | Nagafume et al. | 55/385.2 X |
| 5,828,572 | 10/1998 | Hasegawa et al. | 454/187 X |

FOREIGN PATENT DOCUMENTS

| | | |
|---|---|---|
| 948551 | 8/1956 | Germany . |
| 2553380 | 8/1976 | Germany . |

*Primary Examiner*—Harold Joyce
*Attorney, Agent, or Firm*—Burns, Doane, Swecker & Mathis, L.L.P.

[57] ABSTRACT

An arrangement for supplying air to a room, preferably a clean room, which is divided into zones (A, B, C) with different climatic requirements, comprises a first air treatment unit (11) for supplying air to a pressure chamber (5) which is shared by a plurality of zones and from which air is supplied to the various zones. The arrangement also comprises at least one mixing spaced (14) communicating with the pressure chamber (5) and a second air treatment unit (17). The mixing spaced is intended for mixing of the air from the first (11) and the second (17) air treatment unit. The mixing space also communicates with at least one of the zones (B) for supplying the mixed air to this zone (B).

13 Claims, 3 Drawing Sheets

EQUIPMENT FOR AIR SUPPLY TO A ROOM

INTRODUCTION

The present invention relates to an arrangement for supplying air to a room, preferably a clean room, which is divided into zones with different climatic requirements, comprising a first air treatment unit, from which air is supplied to a pressure chamber, which is shared by a plurality of zones and from which air is supplied to the various zones.

The invention is particularly suited for use in clean rooms having zones, in which very high climatic requirements are placed in terms of temperature and air humidity.

PRIOR-ART TECHNIQUE

Clean rooms are used to an increasing extent in connection with e.g. the manufacture of electronic components and as surgical operating rooms. When producing, for instance, semiconductors, different climatic conditions as to cleanness, temperature and air humidity of the surroundings are often required in different steps of the production process. The clean room in which the production takes place may therefore be divided into zones with different climatic requirements. The zones can be separated from each other by means of walls or screens. The climate in each zone is controlled by keeping the pollution level, temperature and humidity of the air supplied to the respective zones within certain limit values.

U.S. Pat. No. 4,549,472 discloses an arrangement for ventilation of a clean room, which is divided into zones requiring different conditions as to cleanness, temperature and air humidity. The various zones are delimited from each other by means of partitions, which are arranged in the clean room. Above the room, a mixing chamber, which is shared by the zones, is arranged, and above this a common air supply chamber. A return chamber that is shared by the zones is arranged below the clean room. The return chamber communicates via a return conduit with the mixing chamber. The return chamber also communicates via an air treatment unit with the air supply chamber. In the mixing chamber, above each zone with special climatic requirements, a ventilation unit is arranged. The ventilation units comprise a fan chamber, a distribution chamber and a filter container with a so-called HEPA (high efficiency particulate air) filter. The fan chamber is provided with two damper-equipped inlets which can communicate with the mixing chamber and the air supply chamber, respectively.

The climate in the clean room is controlled as follows. Outdoor air and part of the recirculated air from the return chamber are supplied to the air treatment unit, where the air is given a predetermined temperature and humidity. In connection with the air treatment unit, also a primary filtration of the air takes place. The thus treated supply air is supplied to the air supply chamber. The other part of the recirculated air is conducted from the return chamber to the mixing chamber. By controlling the inlet dampers of the ventilation units, it is possible to control the mixing ratio of supply air to recirculating air in the air supplied to the respective zones. A zone requiring a high degree of cleanness but nothing in respect of temperature or air humidity is supplied with recirculated air only, which in fact is already filtered through a HEPA filter when first passing through the ventilation unit. A zone with requirements as to temperature and air humidity only is supplied with merely supply air from the air treatment unit. Zones requiring both a certain degree of cleanness and a certain temperature and air humidity are supplied with a mixture of supply air and recirculated air.

TECHNICAL PROBLEM

The above-described known plant entails a number of drawbacks when supplying air to a clean room which is divided into zones. To begin with, the plant is of complicated design with many components and units. For instance, each zone must be provided with a ventilation unit, which, in addition to the HEPA filter, comprises among other things a fan, two dampers, a fan chamber and a distribution chamber. Besides, each such ventilation unit must be provided with control equipment for controlling the fan and the dampers. This complicated design is not only expensive to install and service, it also requires much space and is sensitive to interruptions of service. The latter constitutes a considerable drawback since the reliability in the operation of clean room plants in, for instance, the production of semiconductors or operating rooms must be extremely great.

A maybe even more serious drawback of the above-described plant is, however, the restricted possibility of controlling the climate of the various zones independently of each other. The prior-art plant comprises only one air treatment unit, which has to satisfy the temperature and air humidity requirements in all zones. Since each zone must generally be supplied with at least a certain amount of outdoor air, this means that the air treatment unit must be dimensioned, for the total supply air flow of the plant, to be able to control temperature and air humidity according to the zone placing the strictest requirements. Thus, if one zone requires, for instance, that the temperature be kept at 20° C.±0.1° C. and that the relative air humidity be kept at 50% RH±1 percentage unit, the air treatment unit must have cooling and air humidifying capacity to keep the supply air flow to all zones within these narrow limits. This applies even if in all other zones it is sufficient to keep the temperature at 22° C.±1° C. and the relative air humidity at 50% RH±5 percentage units. The air treatment unit must thus have a considerable overcapacity in relation to the actual climatic requirements. It goes without saying that such overcapacity causes an unnecessary increase in cost.

A further drawback is that the controlling of temperature and air humidity becomes comparatively slow in the above-described plant. The controlling of the dampers in the ventilation units can but to some extent compensate for changes of the climate in the zones. If rapid and significant changes occur, they must be compensated for by the air treatment unit being caused to supply air having another temperature or air humidity. Such a change cannot be effected instantaneously but requires a certain time of adjustment, especially if the flow rate through the air treatment unit is high. Since the change takes place in the air treatment unit, at a comparatively great distance from the zone involved, it then takes further time before the climate compensation in the supply air becomes noticeable in the zone. The plant thus results in too slow control to satisfy the high tolerance requirements that are placed on the climate in modern clean room plants.

The object of the present invention is therefore to provide a simple arrangement, which is reliable in service and allows, at comparatively low investment and service costs, very rapid and accurate climate control of clean rooms having zones with different climatic requirements.

DESCRIPTION OF THE INVENTION

This object is achieved by an arrangement of the type which is stated in the introductory part and which is characterised in that the pressure chamber and a second air treatment unit communicate with at least one mixing space for mixing air from the pressure chamber and the second air treatment unit, and that the mixing space also communicates with at least one of the zones for supplying the mixed air to said zone.

As a result, it is possible to assign a mixing space to the zones having special climatic requirements. The zones having normal climatic requirements are supplied with air from the pressure chamber only, which in turn is supplied with air from the first air treatment unit. The first air treatment unit can thus be dimensioned to supply a great air flow with only moderate climatic requirements regarding heating, cooling, dehumidification and humidification of the treated air. The strict climatic requirements of the sensitive zones are instead satisfied by mixing a smaller and very accurately controlled flow from the second air treatment unit. The second unit thus must only have capacity of varying the climate of a much smaller flow. Consequently, it is enough to utilise a comparatively small and not very expensive unit for the second air treatment unit.

The second air treatment unit can be adapted to control temperature and/or humidity of the air supplied from this air treatment unit to the mixing space. As a result, the controlling of the most important climate parameters will be satisfied. Regarding the control of the pollution level in the various zones, this suitably is carried out by supplying to each zone air through a filter, the degree of filtration and pore size of which are adapted to the pollution level requirement of the respective zones.

The second air treatment unit can, via conduits, communicate with one or more mixing spaces, in which case means can be arranged to control the flows supplied to the mixing spaces from the second air treatment unit. In this fashion, one and the same second air treatment unit can be used to control the climate in a plurality of sensitive zones. The means for controlling the flows from the second unit make it possible to serve these zones even if they have different climatic requirements. The means for flow control may comprise, preferably remote-controlled, dampers, which are arranged adjacent to the conduit of the respective mixing spaces.

The conduit of the respective mixing spaces can suitably extend into the mixing space and be formed with a plurality of holes through its circumferential surface and/or end surface along that part which is located in the mixing space. The air from the second air treatment unit is thus supplied to the mixing space through the many holes in the conduit, thereby securing good mixing with the air supplied from the pressure chamber.

According to a preferred embodiment, the pressure chamber is at least partly arranged above the zones. The mixing spaces are arranged in the pressure chamber above the respective zones and are partly defined against the pressure chamber with the aid of walls. The mixing spaces further communicate with the respective zones via filters which are arranged in the lower boundary surfaces of the mixing spaces. This design results in a very simple and flexible construction, in which the mixing space simply can be defined by the existing clean room roof and four walls mounted on top of the clean room roof. If the various zones of the clean room are moved, it is very easy to move the mixing spaces correspondingly by just moving the mounted walls and, optionally, the filters arranged in the clean room roof.

The mixing spaces can be provided with perforated portions, which are arranged at the side or sides of the mixing space that has/have no walls towards the pressure chamber. The perforated portions guarantee that the air flowing into the mixing space from the pressure chamber obtains an even velocity profile over the entire cross-sectional area. This results in a further improved mixing of the air from the pressure chamber and from the second air treatment unit.

Another embodiment of the invention implies that one or more mixing spaces are defined against the pressure chamber at least partly by means of filters and against the respective zones by means of a perforated portion. These mixing spaces are suitably arranged under the clean room roof supporting the filters and within the walls defining the zone in the clean room. The mixing space is then defined downwards, against the zone, by a perforated portion. This alternative embodiment confers the advantage that the mixing space for a zone automatically comes along if the zone is moved in the clean room.

The arrangement according to the invention can further have a negative pressure chamber, shared by the various zones and usually in the form of a return chamber, which preferably is arranged below the floor of the zones and which via pressure-reducing means communicates with the zones, said negative pressure chamber also communicating with the first and/or the second air treatment unit for circulation of the air through the arrangement. This makes it possible to re-utilise at least part of the supplied air, which causes a saving in energy since, as a rule, the re-utilised air need not have its temperature changed to a considerable extent before being recirculated to the clean room.

DESCRIPTION OF THE DRAWINGS

Three exemplifying embodiments of the invention will be described below with reference to the accompanying drawings.

Figure 1:
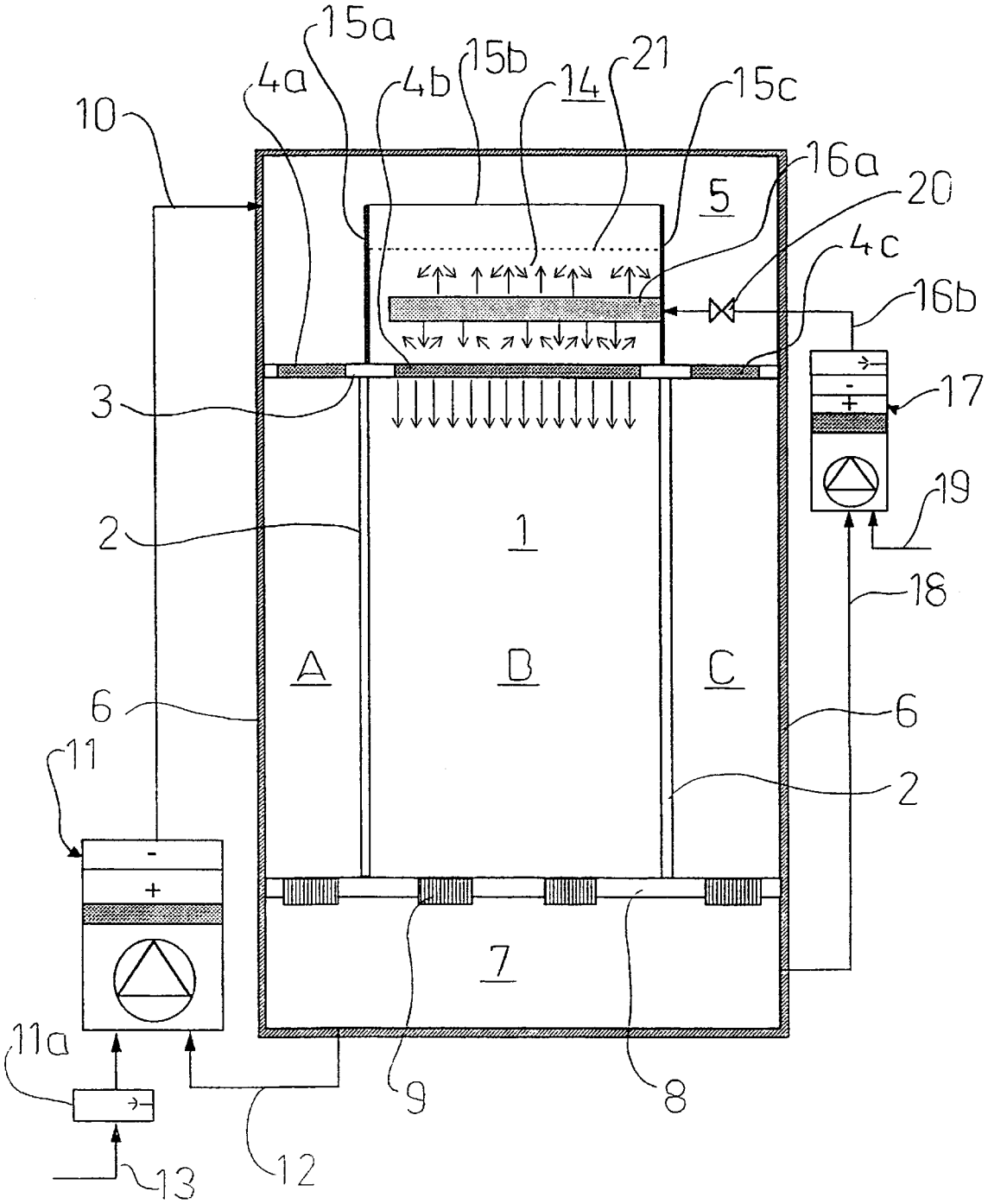
FIG. 1 is a schematic sectional view of an embodiment of an arrangement according to the invention.

The arrangement illustrated in FIG. 1 comprises a clean room 1, which by means of partitions 2 is divided into three different zones A, B, C. In the zones A and C, it is necessary to keep the pollution level under class 1000 according to the U.S. Federal Standard 209E, to keep the temperature at 20° C.±1° C. and to keep the relative humidity at 50% RH±5 percentage units. The zone B is intended to accommodate equipment for extremely sensitive semiconductor manufacture. The climatic requirements for the zone B are therefore considerably more stringent. The pollution level must here be kept under class 1 according to the above-mentioned standard, the temperature must be 18° C. and is allowed to vary by ±0.05° C. only. Regarding the air humidity, this must be 45% RH and is allowed to vary by ±1 percentage unit at most.

The clean room is defined upwards by a clean room roof 3 with inserted HEPA filters 4*a*, 4*b*, 4*c* for filtering of the air supplied to the respective zones. The HEPA filters 4*a*, 4*c*, through which air is supplied to the zones A and C, have the filter efficiency 99.995% for particles larger than 0.12 $\mu$m, while the filter 4*b* above the sensitive zone B has the filter efficiency 99.99995% for the particles that have the most penetrating particle size (MPPS). A pressure chamber 5 is arranged above the clean room roof 3. The clean room is further defined sideways by clean room walls 6 and downwards, against a return chamber 7, by a clean room floor 8. The clean room floor 8 is provided with dampers 9 for regulating the pressure in the various zones. An air supply conduit 10 extends from a first air treatment unit 11 to the pressure chamber 5. From the return chamber 7 extends a return conduit 12 to the first air treatment unit 11. The unit 11 also has an outdoor air intake 13. The first air treatment unit 11 comprises a circulation fan, a prefilter (filter efficiency EU6), a heat exchanger for adjusting the temperature of the air and dehumidification of the air and an air humidifier 11*a*. The different air treatment equipment need not be arranged in one and the same unit, but may be separated from each other. That described above is within the scope of prior-art technique.

In the pressure chamber, above the zone B with particularly strict climatic requirements, a mixing space 14 is arranged. The mixing space 14 is defined downwards, against the zone B, by the clean room roof 3 with the inserted HEPA filter 4*b*. The mixing space 14 is defined against the pressure chamber 5 by four essentially vertical walls 15*a*, 15*b*, 15*c* of smooth metal sheet, aluminium panels or the like. The walls 15*a*, 15*b*, 15*c* are arranged in such manner that the mixing space 14 obtains a rectangular bottom surface having at least the same surface area as the filter 4*b*, through which air is supplied to the zone B.

An air supply conduit 16*a*, 16*b* opens into the mixing space 14. The air supply conduit 16*a*, 16*b* extends through one of the walls 15*c* of the mixing space 14, a part 16*a* of the conduit extending further essentially horizontally into the mixing space 14. The part 16*a* extends into the mixing space 14 a distance corresponding to at least two thirds of the distance between the passed wall 15*c* and its opposite wall 15*a*. The air supply conduit part 16*a* arranged in the mixing space 14 comprises a tube whose circumferential surface over an essential part of the length of the tube has a perforation in the form of a plurality of relatively small through holes. The other part 16*b* of the air supply conduit is connected to a second air treatment unit 17. This air treatment unit is in turn, by means of a conduit 18, connected to the return chamber 7 and optionally by means of an outdoor air conduit 19 to an outdoor air intake (not shown). The second air treatment unit 17 comprises equipment for filtering and accurate control of temperature and humidity of the air supplied to the mixing space through the conduit 16*a*, 16*b*. A control valve 20 is arranged on the conduit 16*b* for controlling the air flow supplied to the mixing space 14 through the conduit 16*a*, 16*b*.

In the upper part of the mixing space 14, above the air supply conduit 16*a* a perforated portion 21 is formed. The perforated portion 21 consists of a perforated metal sheet and extends essentially horizontally over the entire cross-sectional area of the mixing space 14, so as to abut against the four walls 15*a*, 15*b*, 15*c* of the mixing space.

Below follows a description of how the above-described arrangement is used to control the climate in the clean room 1. The first air treatment unit is supplied with outdoor air via the conduit 13 and recirculated air via the conduit 12. In this first air treatment unit 11, the outdoor air and the recirculated air are mixed. The air is also filtered and is given a temperature and humidity conforming with the climatic requirements in the less sensitive zones A and C. In the embodiment illustrated, the air is heated or cooled to 20° C. and by dehumidification or humidification of the air, the relative humidity is regulated to be 50% RH. The thus treated air is supplied by means of the circulation fan in the air treatment unit 11 via the conduit 10 to the pressure chamber, also called the plenum chamber, 5. From the pressure chamber 5 the air passes through the HEPA filters 4*a* and 4*b* to the less sensitive zones A, C. When passing through the HEPA filters, the final pollution control takes place by more than 99.995% of the particles with a diameter above 0.12 $\mu$m being separated. The air supplied to the zones A and C via the filters 4*a*, 4*c* has a comparatively even and laminar flow pattern, pollutants that arise in the zones following the air flow downwards and leaving the zones through the dampers 9 in the clean room floor 8. For the climatic requirements to be satisfied in the less sensitive zones A and C, temperature and air humidity in these zones are measured continuously. If the temperature or the relative humidity should deviate by more than the permissible tolerances, ±1° C. and ±5 percentage units, respectively, this is compensated for by the first air treatment unit 11 changing, to a corresponding degree, temperature and humidity of the air supplied through the conduit 10.

The more sensitive zone B is supplied with air in a different fashion. By regulating the dampers 9 in the clean room floor, depending on the air flows supplied from the first and second air treatment units 11, 17, a certain pressure ratio of the pressure chamber 5, the mixing spice 14, the various zones A, B, C and the return chamber 7 is maintained. Regarding the zone B, this pressure ratio is such that the pressure is highest in the pressure chamber so as to decrease downwards in the mixing space, in the zone B and in the return chamber. Air from the pressure chamber 5 passes, owing to the higher pressure prevailing in the pressure chamber 5, through the perforated portion 21 to the mixing space 14. The mixing space 14 is also supplied with air from the second air treatment unit 14, via the conduit 16*b* with the perforated tube 16*a*. This air is supplied to the mixing space 14 through the many small openings in the circumferential surface of the tube 16*a*. The air supply from the second air treatment unit thus is divided into fine jets, thereby ensuring a very good mixing with the air from the pressure chamber 5 in the mixing space 14. Also the perforated portion 21 contributes to the good mixing by the air passing the perforated portion obtaining an even velocity profile over the entire cross-sectional area. The thus well mixed air passes through the HEPA filter 4*b* to the sensitive zone B. The air supplied to the zone B obtains, like in the zones A and C, an even and essentially laminar flow pattern. Optionally, a second perforated portion (not shown) can be arranged below the HEPA filter so as to further improve the uninterrupted downwardly directed air flow through the sensitive zone. When the air flow has passed down through the zone B, it passes out through the dampers 9 to the return chamber 7, in which it is mixed with the air from the other two zones A and B.

In the example illustrated the temperature in the sensitive zone B should be 18° C., ±0.05° C., i.e. lower than in the other two zones A, C. The air supplied to the mixing space 14 from the second air treatment unit 17 is therefore given a lower temperature than the air supplied from the first air treatment unit 11, via the pressure chamber 5. The difference in temperature between the two flows depends on the size of these flows as well as the extent of heating or cooling of the air that arises in the zone owing to heat exchange with e.g. production machinery, light fittings and the like.

Regarding the relative humidity in the zone B, this should in the example shown be 45% RH, ±1 percentage unit. The air supplied to the mixing space 14 from the second air treatment unit 17 should therefore be drier than the air supplied from the first unit 11. The actual difference in relative humidity depends, analogously with the difference in temperature, on the size of the two flows and the effect of the surroundings on the relative humidity in the zone.

Like in the two less sensitive zones A and C, the temperature and humidity of the air are measured continuously in the zone B. This measurement preferably takes place at the very bottom of the zone. As soon as the temperature or relative humidity changes beyond a predetermined limit value, for instance ±0.02° C. and ±0.5 percentage units, respectively, a correction signal is given to a control unit (not shown). The climate in the zone B can then be corrected by two different methods.

According to one method, the control unit can calculate a flow correction and give a flow correction signal to the control valve 20. By changing the setting of the control valve 20, a change of the air flow supplied from the second air treatment unit 17 then takes place. If, for instance, the temperature and the relative humidity increase in the zone B, this is compensated for by making the control valve 20 increase the flow through the conduit 16*b*, such that a larger amount of colder and drier air is added to the mixing space 14. If instead the temperature and the relative humidity in the zone B fall below the limit values, the control valve is made to throttle the flow from the second air treatment unit 17, such that the air mixture in the mixing space 14 obtains a higher temperature and relative humidity.

According to the other method of correcting the climate in the zone B, the control unit gives a correction signal to the second air treatment unit 17. As a result, the second air treatment unit 17 can be made to directly change temperature and/or relative humidity of the air flow supplied to the mixing space 14 via the conduit 16*a*, 16*b*. This method of controlling affords a greater possibility of compensating for deviations in temperature and relative humidity independently of each other. It is, of course, possible to combine the two methods of correcting climatic changes in the zone B.

What is common to the two methods of correction is that the first air treatment unit 11 can operate without being disturbed and need not correct temperature or humidity of the great air flow supplied from this unit 11. The first air treatment unit 11 can therefore be made considerably simpler and less expensive than if this unit alone should be able to control the climate in the sensitive zone B. The second air treatment unit 17 needs to supply a small flow only, which affords the possibility of making also this unit small and thus not very expensive. The comparatively small size of the flow from the second air treatment unit also results in the possibility of varying the temperature and air humidity very rapidly without the capacity cost of the unit being too high. In the cases where the correction is carried out by controlling the flow through the conduit 16*a*, 16*b*, the compensation in the zone B occurs almost instantaneously.

Figure 2:
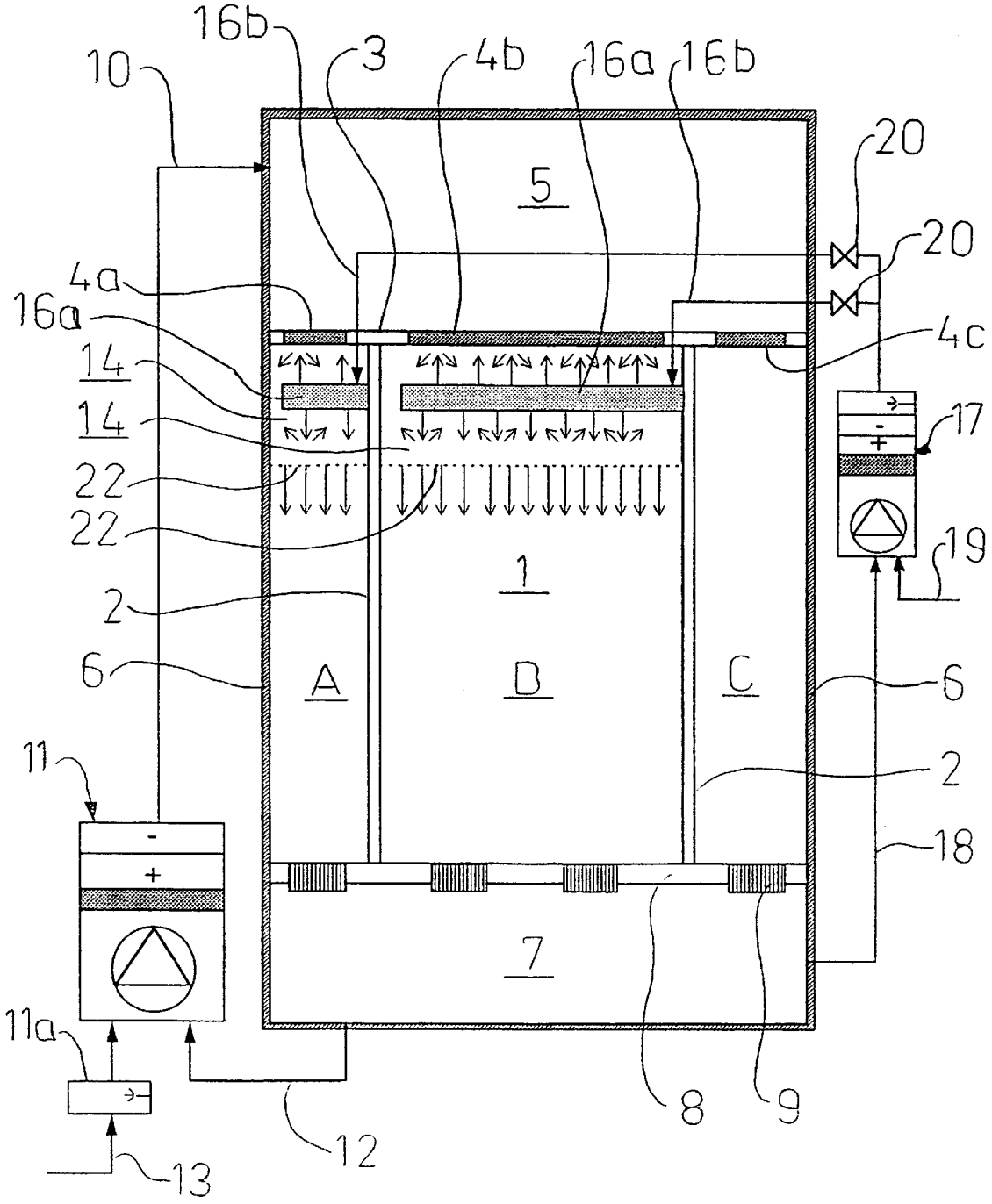
FIG. 2 is a schematic sectional view of a further embodiment of an arrangement according to the invention.

With reference to FIG. 2, a further embodiment of the inventive arrangement will be described below. The arrangement shown in FIG. 2 comprises, like in the above-described embodiment, a clean room 1 which is divided into different zones A, B, C. The zones A and B have higher requirements than the zone C regarding the tolerances within which the temperature and humidity of the zones are allowed to vary. A pressure chamber 5 is arranged above the clean room roof 2 with HEPA filters 4*a*, 4*b*, 4*c*, and a return chamber 7 is arranged below the clean room floor 8 with dampers 9. A first air treatment unit 11 is connected on the suction side to the return chamber 7 and to an outdoor air intake. On the pressure side, the first air treatment unit 11 is connected to a pressure chamber 5 shared by the zones A, B, C. A second air treatment unit 17 communicates on its suction side with the return chamber 7 and, optionally, with an outdoor air intake (not shown).

Below the clean room roof, the more sensitive zones A and B are each provided with a mixing space 14. The mixing spaces are defined upwardly, against the pressure chamber 5, by the clean room roof 3 with the respective filters 4*a*, 4*b*. The mixing spaces 14 are defined sideways by partitions 2 and external walls 6 of the respective zones. Optionally, separate mixing space walls (not shown) can be arranged, suspended from the clean room roof, such that a mixing space having a smaller cross-sectional area forms under the respective filters 4*a*, 4*b*. The two mixing spaces 14 are each defined downwards against the lower part of the zones by a perforated portion 22. In the two mixing spaces 14 extends a perforated tube 16*a* along a considerable distance horizontally through the space 14. The perforated tubes 16*a* communicate via conduits 16*b* and a control valve 20 each with the second air treatment unit 17.

The function of the embodiment shown in FIG. 2 is the same as the function described above. In the latter embodiment, use is, however, made of the control valves 20 to a greater extent to compensate for climatic variations in addition to the permissible limit values in the more sensitive zones A and B. By using the control valves 20 for correction, it is possible to perform climatic compensations in the two more sensitive zones A and B independently of each other. The embodiment shown in FIG. 2 is particularly suitable to install in existing clean room plants, in which the clear height in the pressure chamber 5 above the clean room is limited.

Figure 3:
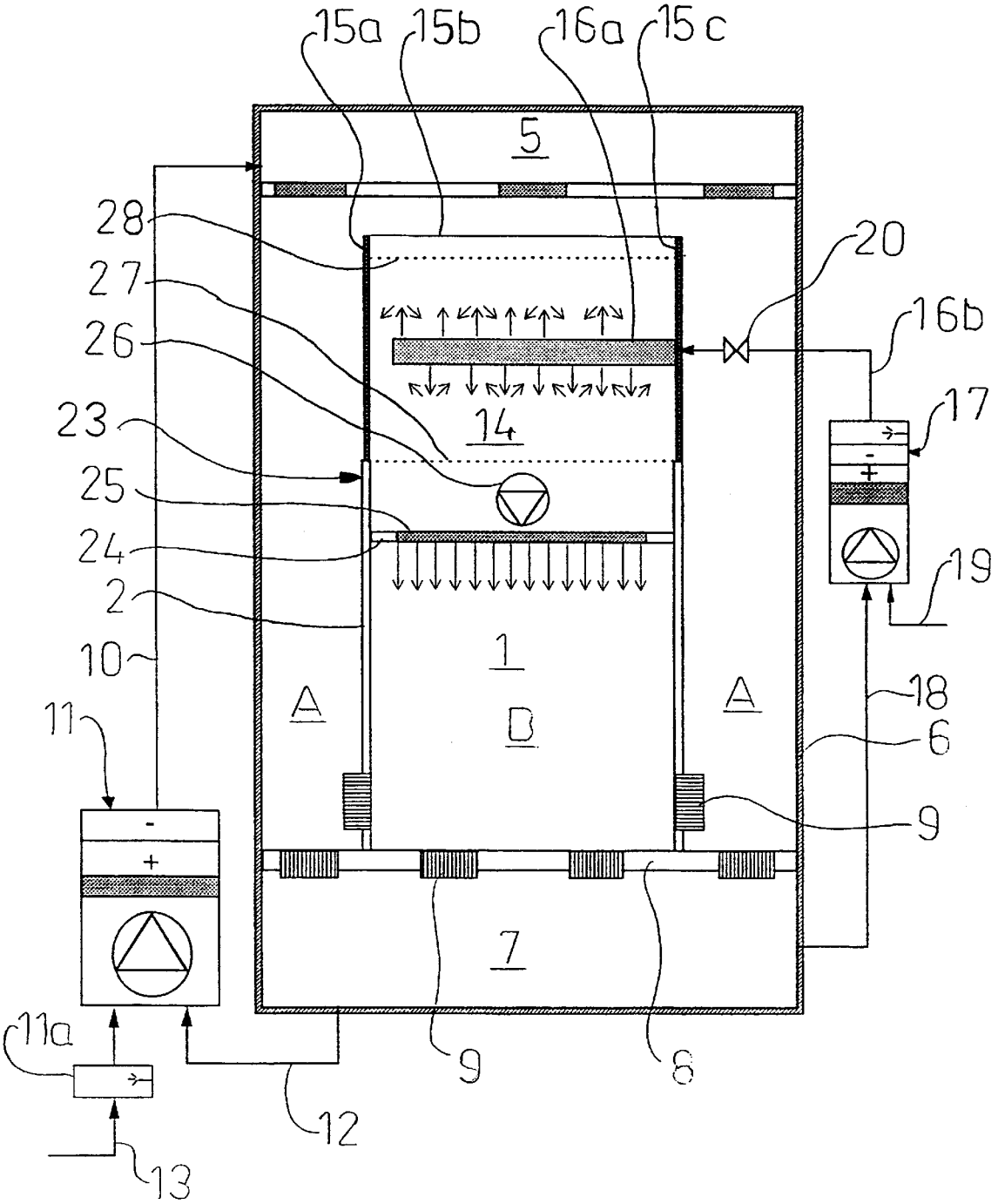
FIG. 3 is a schematic sectional view of one more embodiment of an arrangement according to the invention.

The embodiment shown in FIG. 3 differs from the other two by the sensitive zone B being arranged in a separate unit 23, which is placed in a less sensitive zone A. The zone A may consist of, for instance, an ordinary room. An advantage of this embodiment is that the unit 23 can easily be placed also in rooms that do not satisfy normal clean room requirements. In fact, the unit can be placed in quite ordinary rooms such as in laboratories, assembly shops and offices.

The room A is supplied with air from a first air treatment unit 11 via a pressure chamber 5 provided with filters. It should be noted that the pressure chamber 5 need not necessarily be designed as in the Figure, but may consist of e.g. a ventilation duct. The pressure chamber also need not be provided with filters. In the cases where the pressure chamber is a ventilation duct for supplying air to an ordinary room, an air supply means or a distributing means at the mouth of the duct in the room principally corresponds to the filters.

The zone B is delimited from the room A by means of walls 2 and a separate clean room roof 24 with a HEPA filter 25. Over the separate clean room roof 24, a fan 26 is arranged for circulation of air through the sensitive zone B. Above the fan 26, a lower perforated portion 27 is arranged. The lower perforated portion 27 constitutes the lower definition of a mixing space 14, which is further defined against the room A by four walls 15*a*, 15*b*, 15*c* and an upper perforated portion 28. An air supply conduit 16*a* with a perforated circumferential surface is arranged in the mixing space 14. The air supply conduit 16*a* is connected to a second air treatment unit 17 via the conduit 16*b* and a valve 20. In the lower part of the sensitive zone B, dampers 9 are arranged for supplying air and controlling the pressure in the zone. As above, these dampers can be arranged in the clean room floor 8, between the zone B and a return chamber 7. It is also possible to arrange the dampers 9 in the wall 2 between the zones B and A. The exhaust air from the zone B is then discharged to the surrounding room A. Also a combination of dampers both in the floor and in the wall is feasible.

The function of the device according to the embodiment in FIG. 3 differs from the embodiments previously illustrated by the air from the first air treatment unit 11 not being supplied to the mixing space 14 directly from the pressure chamber 5, but first being supplied to the room A surrounding the zone B. To accomplish the necessary air circulation through the zone B, the fan 26 is operated so as to suck air from the mixing space 14 and blow the air through the HEPA filter 25 into the zone B.

Of course, the invention is not limited to the above-described, exemplifying embodiments, and may be varied within the scope of the appended claims.

For example, the arrangement may comprise several different air treatment units. A mixing space above each zone with particularly strict climatic requirements is suitably connected to a second air treatment unit of its own. This construction allows very accurate control of each sensitive zone. The condition of the air supplied to each sensitive zone can be controlled both by varying the mixing ratio of the amount of air from the pressure chamber to the amount of air from the respective second air treatment units and by varying the condition of the air supplied from the respective second units.

Neither the first nor the second air treatment unit need be supplied with recirculated air but can be supplied with outdoor air only or air from elsewhere. The recirculated air chamber may then be replaced by an exhaust air outlet.

What is claimed is:

1. An arrangement for supplying air to a room which is divided into zones with different climatic requirements, comprising:

a pressure chamber;

a first air treatment unit, from which air is supplied to the pressure chamber, which is shared by a plurality of zones of a room and from which air is supplied to the zones;

a second air treatment unit;

at least one mixing space, the pressure chamber and the second air treatment unit communicating with the at least one mixing space for mixing air from the pressure chamber and the second air treatment unit, the at least one mixing space communicating with at least one of the zones for supplying mixed air to the at least one zone, the second air treatment unit communicating with the at least one mixing space via at least one conduit corresponding to the at least one mixing space; and means adapted to control flow supplied to the at least one mixing space from the second air treatment unit; and the at least one corresponding conduit extending into the at least one mixing space and being formed with a plurality of apertures in at least one of a circumferential surface and an end surface of the at least one corresponding conduit, through which apertures air is supplied from the second air treatment unit to the at least one mixing space.

2. An arrangement as claimed in claim 1, wherein the second air treatment unit is adapted to control at least one of temperature and relative humidity of air supplied from the second air treatment unit to the at least one mixing space.

3. An arrangement as claimed in claim 1, wherein the means for flow control includes dampers arranged at least one of in and adjacent to the at least one corresponding conduit of the at least one mixing space.

4. An arrangement as claimed in claim 1, wherein the pressure chamber is at least partly arranged above the zones, the at least one mixing space is arranged in the pressure chamber and is at least partly defined by walls, the at least one mixing space communicating with the zones via filters arranged in lower boundary surfaces of the at least one mixing space.

5. An arrangement as claimed in claim 4, wherein at least one perforated portion is arranged at at least one side of the at least one mixing space.

6. An arrangement as claimed in claim 1, wherein the at least one mixing space is defined at least partly by at least one filter and a perforated portion.

7. An arrangement as claimed in claim 1, further comprising a suction chamber which is shared by the zones and arranged under the zones and which, via pressure-reducing means, communicates with the zones, the suction chamber also communicating with the first and the second air treatment unit.

8. An arrangement as claimed in claim 2, wherein the pressure chamber is at least partly arranged above the zones, the at least one mixing space is arranged in the pressure chamber and is at least partly defined by walls, the at least one mixing space communicating with the zones via filters arranged in lower boundary surfaces of the at least one mixing space.

9. An arrangement as claimed in claim 3, wherein the pressure chamber is at least partly arranged above the zones, the at least one mixing space is arranged in the pressure chamber and is at least partly defined by walls, the at least one mixing space communicating with the zones via filters arranged in lower boundary surfaces of the at least one mixing space.

10. An arrangement as claimed in claim 2, wherein the at least one mixing space is defined at least partly by at least one filter and a perforated portion.

11. An arrangement as claimed in claim 3, wherein the at least one mixing space is defined at least partly by at least one filter and a perforated portion.

12. An arrangement as claimed in claim 2, further comprising a suction chamber which is shared by the zones and arranged under the zones and which, via pressure-reducing means, communicates with the zones, the suction chamber also communicating with the first and the second air treatment unit.

13. An arrangement as claimed in claim 3, further comprising a suction chamber which is shared by the zones and arranged under the zones and which, via pressure-reducing means, communicates with the zones, the suction chamber also communicating with the first and the second air treatment unit.

* * * * *